US008070107B2

(12) United States Patent
Chen et al.

(10) Patent No.: US 8,070,107 B2
(45) Date of Patent: Dec. 6, 2011

(54) NET STRUCTURE AND METHODS OF MAKING THE SAME

(75) Inventors: Chung-Ping Chen, Pingtung County (TW); Shun-Fang Chen, Pingtung County (TW)

(73) Assignee: Kang-Chan Enterprise Corporation, Pingtung County (TW)

( * ) Notice: Subject to any disclaimer, the term of this patent is extended or adjusted under 35 U.S.C. 154(b) by 0 days.

(21) Appl. No.: 12/716,826

(22) Filed: Mar. 3, 2010

(65) Prior Publication Data

US 2010/0224736 A1 Sep. 9, 2010

(30) Foreign Application Priority Data

Mar. 4, 2009 (CN) ..... 2009 1 0118148

(51) Int. Cl.
*B21F 27/14* (2006.01)
*B21F 15/04* (2006.01)
*B21F 7/00* (2006.01)
*B21F 99/00* (2009.01)

(52) U.S. Cl. ..... 245/7; 245/1; 245/2; 245/5

(58) Field of Classification Search ..... 245/1, 2–7, 245/9–11; 87/3, 8–12
See application file for complete search history.

(56) References Cited

U.S. PATENT DOCUMENTS 1,783,858 A * 12/1930 Seiwerts ..... 87/10
2,679,368 A * 5/1954 Aigner ..... 245/7
3,145,001 A * 8/1964 Bruninga ..... 245/7
3,682,419 A * 8/1972 Vanderfaeillie ..... 245/7
5,255,998 A 10/1993 Beretta
5,639,543 A 6/1997 Isoda et al.
6,168,118 B1 * 1/2001 Vancraeynest et al. ..... 245/5
6,279,858 B1 * 8/2001 Eicher ..... 245/8
6,536,323 B2 * 3/2003 Nagaoka ..... 87/3
7,048,984 B2 5/2006 Seth et al.
7,325,774 B2 * 2/2008 Jun et al. ..... 245/2
2002/0092414 A1 * 7/2002 Nagaoka ..... 87/8
2006/0131463 A1 * 6/2006 Jun et al. ..... 245/2

* cited by examiner

*Primary Examiner* — Bobby Muromoto, Jr.
(74) *Attorney, Agent, or Firm* — Muncy, Geissler, Olds & Lowe, PLLC

(57) ABSTRACT

A net structure includes a plurality of metal rightwards inclined wires including, in sequence, a first rightwards inclined wire, a second rightwards inclined wire, and an N-th rightwards inclined wire. The net structure further includes a plurality of metal leftwards inclined wires including, in sequence, a first leftwards inclined wire, a second leftwards inclined wire, and an N-th leftwards inclined wire. The first rightwards inclined wires intersects, in sequence, from the first rightwards inclined wire through the N-th rightwards inclined wire at an intersection at which a twine portion is formed. The second rightwards inclined wires intersects, in sequence, from the second rightwards inclined wire through the N-th rightwards inclined wire at an intersection at which a twine portion is formed. The N-th leftwards inclined wire intersects the N-th rightwards inclined wire at an intersection at which a twine portion is formed, thereby forming a net structure with a plurality of hexagonal meshes. The net structure is made by slant weaving.

18 Claims, 5 Drawing Sheets

NET STRUCTURE AND METHODS OF MAKING THE SAME

BACKGROUND OF THE INVENTION

1. Field of the Invention

The present invention relates to a net structure and methods for making the net structure and, more particularly, to a net structure made by slant weaving and methods for making the net structure.

2. Description of the Related Art

With reference to FIG. 1, a conventional net structure generally includes a plurality of side wires 91, a plurality of first metal wires 92, and a plurality of second metal wires 93. The side wires 91 together form a frame. The first and second metal wires 92 and 93 form a plurality of hexagonal meshes 94 inside the frame. Each first metal wire 92 includes a plurality of first extensions 95 and a plurality of first winding portions 96. The first extensions 95 and the first winding portions 96 are alternatively disposed. Furthermore, two adjacent first extensions 95 of the same first metal wire 92 extend in two different directions. As an example, the first extension portions 95' and 95''' extends leftward and downwards (see arrow α in FIG. 1), whereas the first extension portion 95'' extends rightwards and downwards (see arrow β in FIG. 1). Each second metal wire 93 includes a plurality of second extensions 97 and a plurality of second winding portions 98. The second extensions 97 and the second winding portions 98 are alternatively disposed. Similar to the first extension portions 95 of the first metal wires 92, two adjacent second extensions 97 of the same second metal wire 93 extend in two different directions.

By such an arrangement, a plurality of the first winding portions 96 of each of the first metal wires 92' is intertwined with a plurality of the second winding portions 98 of two of the second metal wires 93' and 93''. Thus, the first metal wires 92' and the second metal wires 93' extend in a direction perpendicular to the extending direction of the side wires 91. Furthermore, two sides of each hexagonal mesh 94 are twine portions 99 formed by one of the first winding portions 96 and one of the second winding portions 98. It is noted that each of the first metal wires 92' and an adjacent second metal wire 93' form a plurality of twine portions 99. The number of turns of each twine portion 99 of the conventional net structure is odd. In the conventional net structure shown in FIG. 1, the number of turns of each twine portion 99 is three.

However, since each first metal wire 92' is merely intertwined with two second metal wires 93', when any first metal wire 92' breaks, an elongated hole A is formed between two second metal wires 93' and has a size six times the size of a mesh 94, as shown in FIG. 2. The size of the hole A increases when the length of the broken first metal wire 92' increases. In a case that the net structure is utilized as a net to hold stones, larger stones are liable to pass through the large hole A, failing to provide sufficient structural strength and failing to avoid landslide.

Thus, a need exists for an improved net structure with sufficient structural strength and for methods for making such a net structure.

SUMMARY OF THE INVENTION

An objective of the present invention is to provide a net structure without the problems of large holes when it is broken.

Another objective of the present invention is to provide a method for making the above-mentioned net structure.

A further objective of the present invention is to provide a method for making a net structure with side wires.

The present invention fulfills the above objectives by providing, in a preferred form, a net structure including a plurality of metal rightwards inclined wires including, in sequence, a first rightwards inclined wire, a second rightwards inclined wire, and an N-th rightwards inclined wire. The net structure further includes a plurality of metal leftwards inclined wires including, in sequence, a first leftwards inclined wire, a second leftwards inclined wire, and an N-th leftwards inclined wire. The first rightwards inclined wires intersects, in sequence, from the first rightwards inclined wire through the N-th rightwards inclined wire at an intersection at which a twine portion is formed. The second rightwards inclined wires intersects, in sequence, from the second rightwards inclined wire through the N-th rightwards inclined wire at an intersection at which a twine portion is formed. The N-th leftwards inclined wire intersects the N-th rightwards inclined wire at an intersection at which a twine portion is formed, thereby forming a net structure with a plurality of hexagonal meshes.

A method for making a net structure according to the preferred teachings of the present invention includes: (a) selecting a plurality of positioning points on a boundary; (b) providing a plurality of rightwards inclined wires and a plurality of leftwards inclined wires, with a first end of each of the rightwards inclined wires and a first end of a respective one of the leftwards inclined wires fixed to a respective one of the positioning points; (c) intertwining and extending a second end of each of the rightwards inclined wires and a second end of a respective one of the leftwards inclined wires, with the second end of each of the rightwards inclined wires and the second end of a respective one of the leftwards inclined wires being intertwined a plurality of turns to form a twine portion having a beginning fixed to a respective one of the positioning points and an end distant to the boundary, with each of the beginning and the end being an intersection; (d) extending each of the rightwards inclined wires from the end of the twine portion in a first direction, and extending each of the leftwards inclined wires from the end of the twine portion in a second direction, with each of the rightwards inclined wires intersecting an adjacent one of the leftwards inclined wires at another intersection; (e) extending and intertwining each of the rightwards inclined wires and a respective one of the leftwards inclined wires from one of the intersections away from the boundary, with each of the rightwards inclined wires and a respective one of the leftwards inclined wires being intertwined a plurality of turns to form a twine portion having a beginning adjacent to the boundary and an end distant to the boundary; and (f) repeating steps (d) and (e) until a net structure with a desired size is obtained.

Another method for making a net structure according to the preferred teachings of the present invention includes: (a) selecting a plurality of positioning points and two side positioning points on a boundary, with the plurality of positioning points arranged between the two side positioning points; (b) providing a plurality of rightwards inclined wires, a plurality of leftwards inclined wires, and two side boundary wires, with a first end of each of the rightwards inclined wires and a first end of a respective one of the leftwards inclined wires fixed to a respective one of the positioning points, with first ends of the two side boundary wires respectively fixed to the two side positioning points; (c) extending and intertwining a second end of each of the rightwards inclined wire and a second end of a respective one of the leftwards inclined wires, with the second end of each of the rightwards inclined wires and the second end of a respective one of the leftwards inclined wires being intertwined a plurality of turns to form a twine portion having a beginning fixed to a respective one of the positioning points and an end distant to the boundary, and extending the two side boundary wires away from the boundary; (d) extending each of the rightwards inclined wires from the end of the twine portions in a first direction, and extending each of the leftwards inclined wires from the end of the twine portions in a second direction, with each of the rightwards inclined wires intersecting an adjacent one of the leftwards inclined wires or one of the two side boundary wires at an intersection; (e) extending and intertwining the rightwards inclined wires, the leftwards inclined wires, and the two side boundary wires from each of the intersections away from the boundary a plurality of turns to form a plurality of twine portions, with each of the twine portions including a beginning and an end; (f) extending each of the rightwards inclined wires in the first direction and extending each of the leftwards inclined wires in the second direction, with a right side boundary wire of the two side boundary wires being intertwined with one of the leftwards inclined wires a plurality of turns and then extending in the second direction, with a left side boundary wire of the two side boundary wires being intertwined with one of the rightwards inclined wires a plurality of turns and then extending in the first direction, with one of the rightwards inclined wires and one of the leftwards inclined wires extending in a third direction away form the boundary, and defining a portion of the right side boundary wires extending in the second direction as one of the leftwards inclined wires, a portion of the left side boundary wires extending in the first direction as one of the rightwards inclined wires, and the rightwards and leftwards inclined wires extending in the third direction as two side boundary wires; (g) extending and intertwining each of the rightwards inclined wires and a respective one of the leftwards inclined wires from the intersection away from the boundary a plurality of turns to form a plurality of twine portions each having a beginning and an end; and (h) repeating steps (d)-(g) until a net structure with a desired size is obtained.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
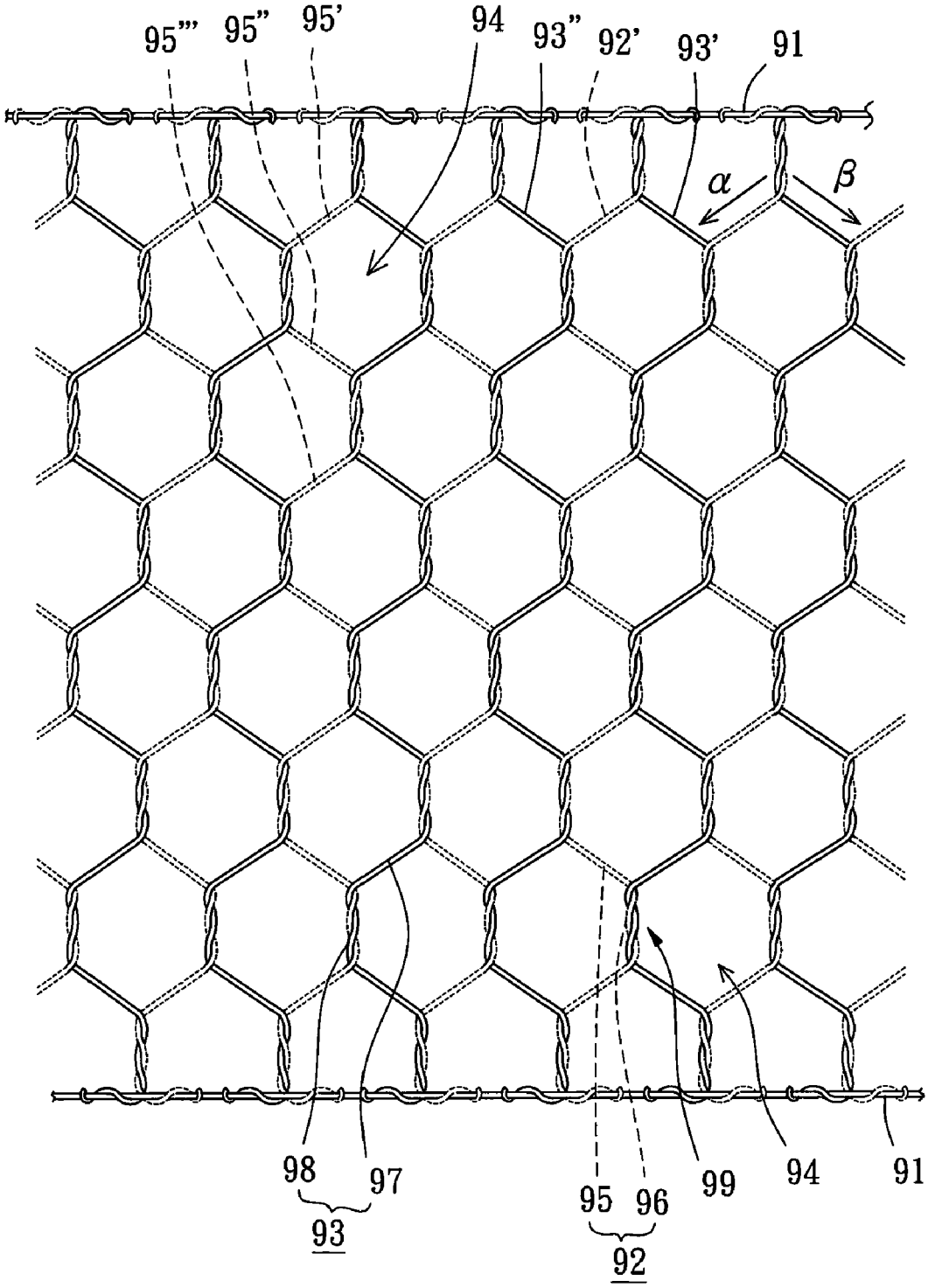
FIG. 1 PRIOR ART
FIG. 1 shows a plan view of a conventional net structure.
Figure 2:
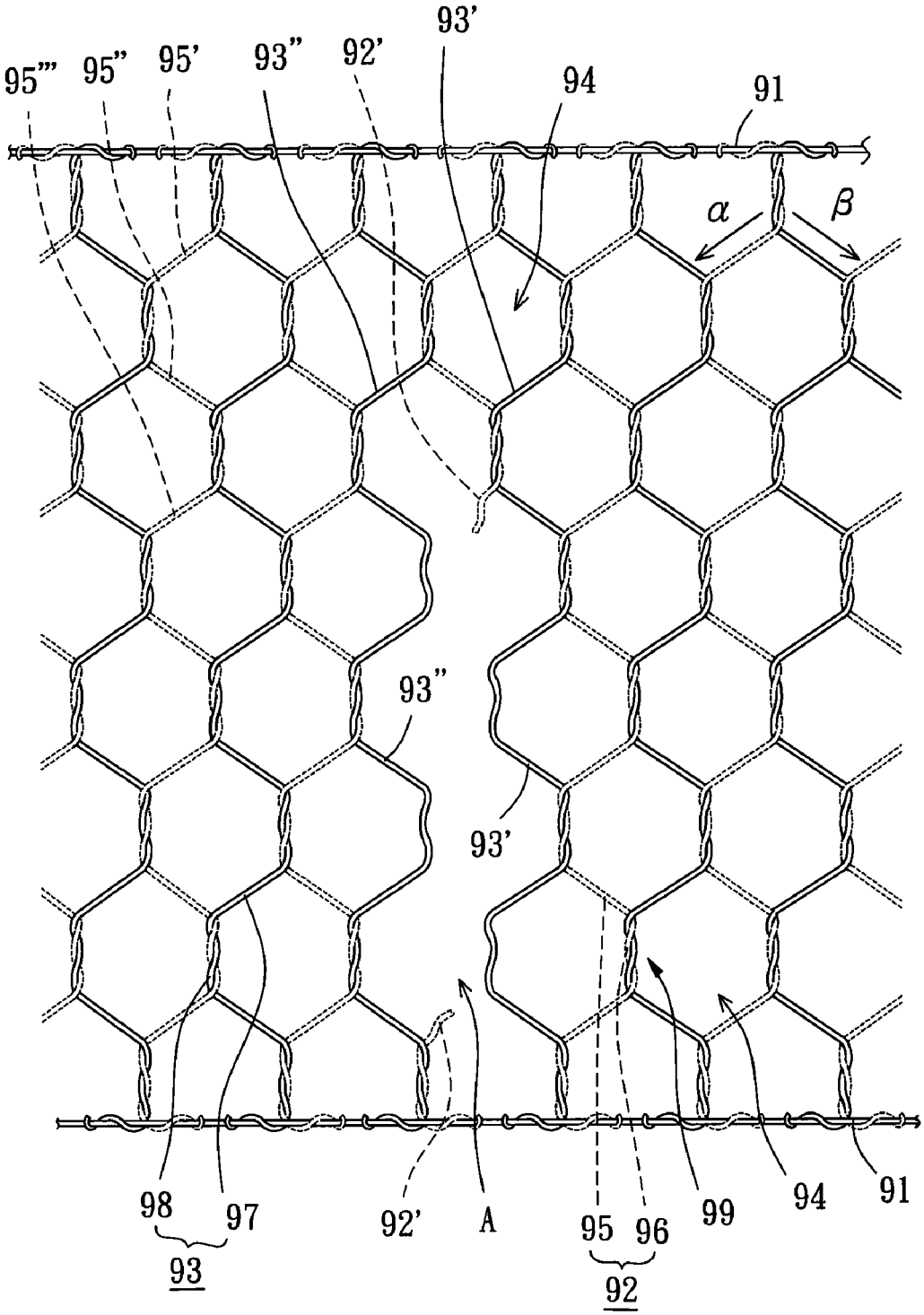
FIG. 2 PRIOR ART
FIG. 2 shows a plan view of the net structure of FIG. 1 with a portion of the net structure broken.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "side", "beginning", "end", "portion", "rightwards", "leftwards", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 4:
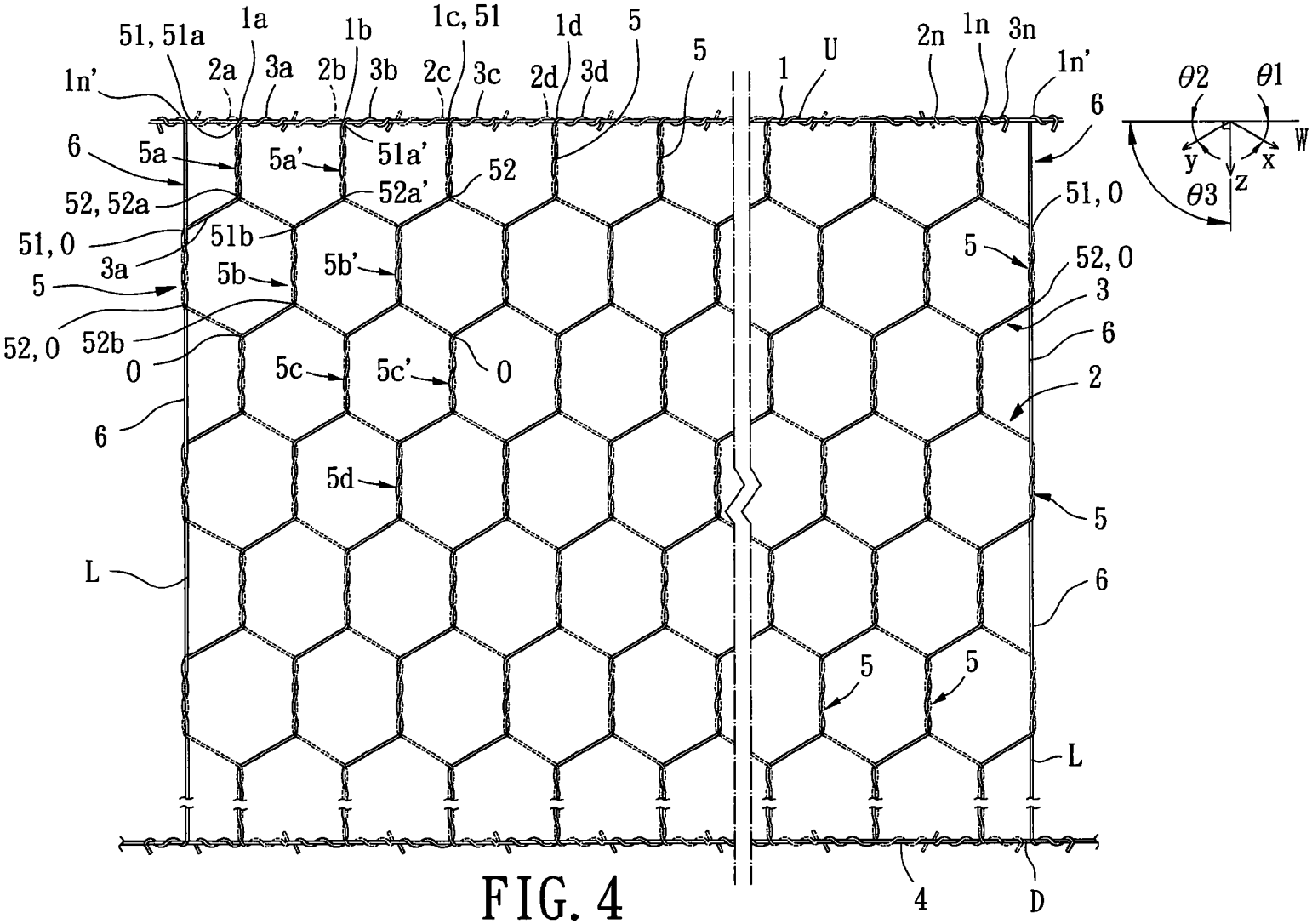
FIG. 4 shows a plan view of a net structure according to the preferred teachings of the present invention.

The term "boundary" used herein means a side of a net structure according to the preferred teachings of the present invention. The boundary may include a first boundary U, a second boundary D, and two side boundaries L, as shown in FIG. 4.

The term "bench mark line W" used herein means a side of the net structure according to the preferred teachings of the present invention. In the preferred form shown, the bench mark line W is the first boundary U.

Figure 3:
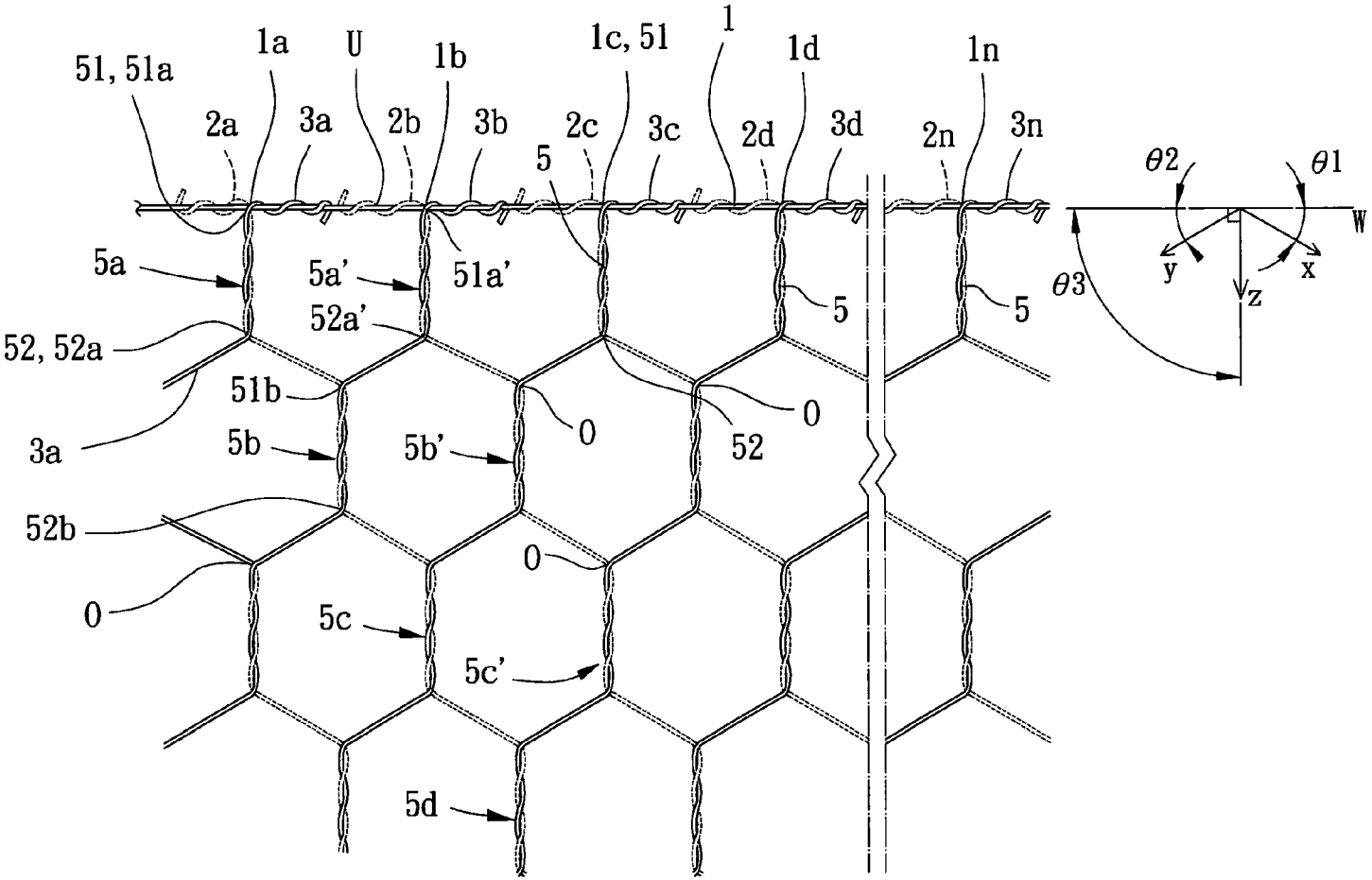
FIG. 3 shows a partial, plan view of a net structure according to the preferred teachings of the present invention.

The term "first direction" used herein means a direction at a first angle θ1 to the bench mark line W (see the first direction x in FIG. 3). The first angle θ1 is preferably not a right angle.

The term "second direction" used herein means a direction at a second angle θ2 to the bench mark line W (see the second direction y in FIG. 3). The second angle θ2 is preferably not a right angle.

The term "third direction" used herein means a direction at a third angle θ3 to the bench mark line W (see the third direction z in FIG. 3). The third angle θ3 is a right angle in the preferred form shown. However, the third angle θ3 can be other than a right angle.

The term "intersection O" used herein means an intersection of the first, second, and third directions x, y, and z. The number of the intersections O is N in the net structure according to the preferred teachings of the present invention.

The term "rightwards inclined wire" used herein means a wire or a wire portion that extends in the first direction x.

The term "leftwards inclined wire" used herein means a wire or a wire portion that extends in the second direction y.

The term "twine portion" used herein means two wire portions of two wires that are intertwined and extended in the third direction z.

A net structure according to the preferred teachings of the present invention is shown in FIGS. 3 and 4. The net structure includes a first boundary U, a plurality of rightwards inclined wires 2, and a plurality of leftwards inclined wires 3. The rightwards inclined wires 2 and the leftwards inclined wires 3 are made of steel or iron. Furthermore, the rightwards inclined wires 2 and the leftwards inclined wires 3 together form a plurality of hexagonal meshes.

In the preferred form shown in FIGS. 3 and 4, the net structure according to the preferred teachings of the present invention includes a first boundary U, a second boundary D, and two side boundaries L. A first boundary wire 1 is located on the first boundary U. A second boundary wire 4 is located on the second boundary D. The first and second boundary wires 1 and 4 have a predetermined length and are substantially parallel to each other. The side boundaries L are parallel to each other and to the third direction z.

A method for making the net structure according to the preferred teachings of the present invention will now be described with reference to FIG. 3. Firstly, at step (a), N positioning points are selected on the first boundary U. The first boundary U can be the first boundary wire 1 of a predetermined length. Thus, the first boundary wire 1 has N positioning points 1*a*-1*n*, including, from left to right in sequence, the first positioning point 1*a*, the second positioning point 1*b*, the third positioning point 1*c*, the fourth positioning point 1*d* . . . and the N-th positioning point 1*n*, as shown in FIG. 3. In the preferred form shown, the N positioning points 1*a*-1*n* are spaced at regular intervals along the first boundary wire 1.

Next, at step (b), a plurality of rightwards inclined wires 2 and a plurality of leftwards inclined wires 3 are provided. Each of the positioning points 1*a*-1*n* serves as a starting point of a first end of one of the rightwards inclined wires 2 and a starting point of a first end of a respective one of the leftwards inclined wires 3. Specifically, both of the first end of the first rightwards inclined wire 2*a* and the first end of the first leftwards inclined wire 3*a* are located on the first positioning point 1*a* and use the first positioning point 1*a* as the starting points. Likewise, both of the first end of the second rightwards inclined wire 2*b* and the first end of the second leftwards inclined wire 3*b* are located on the second positioning point 1*b* and use the second positioning point 1*b* as the starting points. Likewise, both of the first end of the third rightwards inclined wire 2*c* and the first end of the third leftwards inclined wire 3*c* are located on the third positioning point 1*c* and use the third positioning point 1*c* as the starting points. Likewise, both of the first end of the fourth rightwards inclined wire 2*d* and the first end of the fourth leftwards inclined wire 3*d* are located on the fourth positioning point 1*d* and use the fourth positioning point 1*d* as the starting points. Likewise, both of the first end of the N-th rightwards inclined wire 2*n* and the first end of the N-th leftwards inclined wire 3*n* are located on the N-th positioning point 1*n* and use the N-th positioning point 1*n* as the starting points. Furthermore, both of the first ends of the rightwards inclined wire 2 and the leftwards inclined wires 3 can be wound and fixed along the first boundary wire 1 to enhance the engaging strength between the first boundary wire 1 and each of the rightwards and leftwards inclined wires 2 and 3. Further, both of the first ends of each rightwards inclined wire 2 and a respective one of the leftwards inclined wires 3 can be connected together, with these two inclined wires 2 and 3 commonly fixed at the positioning point serving as the starting points thereof.

Next, at step (c), a second end of each rightwards inclined wires 2 and a second end of a respective one of the leftward inclined wires 3 whose first ends are fixed at the same one of the positioning points 1*a*-1*n* are intertwined and extended away from the first boundary wire 1 in the third direction z to form a twine portion 5 having a beginning 51 and an end 52. For the twine portion 5, numbers of turns of the rightwards inclined wire 2 and the leftward inclined wire 3 are preferably even. More specifically, the second end of the first rightwards inclined wire 2*a* and the second end of the first leftwards inclined wire 3*a* whose first ends are fixed at the first positioning point 1*a* are intertwined and extended away from the first boundary wire 1 in the third direction z to form a twine portion 5*a* having a beginning 51*a* at the first positioning point 1*a*. After being intertwined even times, an end 52*a* is formed. The beginning 51*a* and the end 52*a* are the intersections O. Likewise, after being intertwined a plurality of turns, the second rightwards inclined wire 2*b* and the second leftwards inclined wire 3*b* together form a twine portion 5*a*' having a beginning 51*a*' and an end 52*a*'. This applies from the first rightwards and leftwards inclined wires 2*a* and 3*a* to the N-th rightwards and leftwards inclined wires 2*n* and 3*n*. Thus, the leftwards and rightwards inclined wires 2 and 3 form a plurality of twine portions 5 extending in the third direction z.

Next, at step (d), from the end 52 of each twine portion 5, each rightwards inclined wire 2 is extended in the first direction x, and each leftwards inclined wire 3 is extended in the second direction y. Furthermore, each rightwards inclined wire 2 intersects an adjacent leftwards inclined wire 3 at another intersection O. More specifically, the first rightwards inclined wire 2*a* is extended from the end 52*a* in the first direction x, and the second leftwards inclined wire 3*b* is extended from the end 52*a*' in the second direction y. Thus, the first rightwards inclined wire 2*a* intersects the second leftwards inclined wire 3*b* at another intersection O. Likewise, the second rightwards inclined wire 2*b* intersects the third leftwards inclined wire 3*c* at another intersection O, the third rightwards inclined wire 2*c* intersects the fourth leftwards inclined wire 3*d* at another intersection O, etc. Thus, N intersections O are formed by the rightwards inclined wires 2 and the leftwards inclined wires 3 after extension.

Next, at step (e), each rightwards inclined wire 2 and a respective one of the leftwards inclined wires 3 are extended from their intersection O in the third direction z and intertwined a plurality of turns to form a twine portion 5 having a beginning 51 and an end 52. More specifically, from the intersection O of the first rightwards inclined wire 2*a* and the second leftwards inclined wire 3*b*, the first rightwards inclined wire 2*a* and the second leftwards inclined wire 3*b* are intertwined a plurality of turns and extended away from the first boundary wire 1 in the third direction z to form a twine portion 5*b* having a beginning 51*b* and an end 52*b*. Likewise, from the intersection O of the second rightwards inclined wire 2*b* and the third leftwards inclined wire 3*c*, the second rightwards inclined wire 2*b* and the third leftwards inclined wire 3*c* are intertwined a plurality of turns and extended away from the first boundary wire 1 in the third direction z to form a twine portion 5*b*'. Thus, each rightwards inclined wire 2 and a respective one of the leftwards inclined wires 3 together form a twine portion 5 again after intertwining.

At step (f), the procedures mentioned in steps (d) and (e) are repeated until a net structure with a desired size is obtained. More specifically, by repeating steps (d) and (e), a net structure with a desired size and with a plurality of hexagonal meshes shown in FIG. 3 can be obtained.

It can be appreciated that the second end of each rightwards inclined wire 2 and the second end of each leftwards inclined wire 3 can be fixed to a second boundary wire 4 to obtain a net structure having the second boundary D, as shown in FIG. 4.

Another method for making a net structure with two side boundaries L will now be described with reference to FIG. 4. Firstly, at step (a), N positioning points and two side positioning points 1*n*' are selected on a first boundary U. The first boundary U can be the first boundary wire 1 of a predetermined length. The first boundary wire 1 has two ends on which the two side positioning points 1*n*' are located. Also located on the first boundary wire 1 and between the side positioning points 1*n*' are N positioning points 1*a*-1*n*, including, from left to right in sequence, the first positioning point 1*a*, the second positioning point 1*b*, the third positioning point 1*c*, the fourth positioning point 1*d* . . . and the N-th positioning point 1*n*, as shown in FIG. 4. In the preferred form shown, the N positioning points 1*a*-1*n* are spaced at regular intervals along the first boundary wire 1.

Next, at step (b), a plurality of rightwards inclined wires 2, a plurality of leftwards inclined wires 3, and two side boundary wires 6 are provided. A first end of each rightwards inclined wire 2 and a first end of a respective one of the leftwards inclined wires 3 are connected together, with these two inclined wires 2 and 3 preferably and commonly fixed at a respective one of the positioning points 1*a*-1*n*. Furthermore, first ends of the side boundary wires 6 are respectively fixed on the side positioning points 1*n*'. In the preferred form shown in FIG. 4, both of the first end of the first rightwards inclined wire 2*a* and the first end of the first leftwards inclined wire 3*a* are fixed to the first positioning point 1*a*. Likewise, both of the first end of the second rightwards inclined wire 2*b* and the first end of the second leftwards inclined wire 3*b* are fixed to the second positioning point 1*b*. Likewise, both of the first end of the third rightwards inclined wire 2*c* and the first end of the third leftwards inclined wire 3*c* are fixed to the third positioning point 1*c*. Likewise, both of the first end of the fourth rightwards inclined wire 2*d* and the first end of the fourth leftwards inclined wire 3*d* are fixed to the fourth positioning point 1*d*. Likewise, both of the first end of the N-th rightwards inclined wire 2*n* and the first end of the N-th leftwards inclined wire 3*n* are fixed to the N-th positioning point 1*n*. The first ends of the side boundary wires 6 are respectively fixed to the side positioning points 1*n*'. Furthermore, the first end of each rightwards inclined wire 2, the first end of each leftwards inclined wire 3, and the first end of each side boundary wire 6 can be wound and fixed along the first boundary wire 1 to enhance the engaging strength between the first boundary wire 1 and each of the wires 2, 3, and 6.

Next, at step (c), a second end of each rightwards inclined wire 2 and a second end of a respective one of the leftward inclined wires 3 whose first ends are fixed at the same one of the positioning points 1*a*-1*n* are intertwined and extended away from the first boundary wire 1 in the third direction z to form a twine portion 5 having a beginning 51 and an end 52. For the twine portion 5, numbers of turns of the rightwards inclined wire 2 and the leftward inclined wires 3 is preferably even. Furthermore, each side boundary wire 6 extends away from the first boundary wire 1 in the third direction z. In the preferred form shown in FIG. 4, the second end of the first rightwards inclined wire 2*a* and the second end of the leftwards inclined wires 3*a* whose first ends are fixed at the first positioning point 1*a* are intertwined and extended away from the first boundary wire 1 in the third direction z to form a twine portion 5*a* having a beginning 51*a* at the first positioning point 1*a*. After being intertwined even times, an end 52*a* is formed. The beginning 51*a* and the end 52*a* are the intersections O. Likewise, after being intertwined a plurality of turns, the second rightwards inclined wire 2*b* and the second leftwards inclined wire 3*b* together form a twine portion 5*a*' having a beginning 51*a*' and an end 52*a*'. This applies from the first rightwards and leftwards inclined wires 2*a* and 3*a* to the N-th rightwards and leftwards inclined wires 2*n* and 3*n*. Thus, the leftwards and rightwards inclined wires 2 and 3 form a plurality of twine portions 5 extending in the third direction z. Furthermore, each side boundary wire 6 is extended away from the first boundary wire 1 in the third direction z.

Next, at step (d), from the end 52 of each twine portion 5, each rightwards inclined wire 2 is extended in the first direction x, and each leftward inclined wire 3 is extended in the second direction y. Furthermore, each rightwards inclined wire 2 intersects an adjacent leftwards inclined wire 3 or one of the side boundary wires 6 at another intersection O. More specifically, the first rightwards inclined wire 2*a* is extended from the end 52*a* in the first direction x, and the second leftwards inclined wire 3*b* is extended from the end 52*a*' in the second direction y. Thus, the first rightwards inclined wire 2*a* intersects the second leftwards inclined wire 3*b* at another intersection O. Likewise, the second rightwards inclined wire 2*b* intersects the third leftwards inclined wire 3*c* at another intersection O, the third rightwards inclined wire 2*c* intersects the fourth leftwards inclined wire 3*d* at another intersection O, etc. Thus, N intersections O are formed by the rightwards inclined wires 2 and the leftwards inclined wires 3 after extension. On the right boundary L, the N-th rightwards inclined wire 2*n* intersects the right side boundary wire 6 at an intersection O. On the left boundary L, the first leftwards inclined wire 3*a* intersects the left side boundary wire 6 at an intersection O.

Next, at step (e), each rightwards inclined wire 2 and a respective one of the leftwards inclined wires 3 are extended from their intersection O in the third direction z and intertwined a plurality of turns to form a twine portion 5 having a beginning 51 and an end 52. Furthermore, on the right boundary L, the right side boundary wire 6 intersects and is intertwined with the N-th rightwards inclined wire 2*n* a plurality of turns in the third direction z away from the first boundary wire 1, forming a twine portion 5 having a beginning 51 and an end 52 both of which are intersections O. On the left boundary L, the left side boundary wire 6 intersects and is intertwined with the first leftwards inclined wire 3*a* a plurality of turns in the third direction z away from the first boundary wire 1, forming a twine portion 5 having a beginning 51 and an end 52 both of which are intersections O.

Next, at step (f), from the end 52 (i.e., the intersection O), after forming the twine portion 5 on the right boundary L, the right side boundary wire 6 is extended in the second direction y and the N-th rightwards inclined wire 2*n* is extended in the third direction z, wherein a portion of the right side boundary wire 6 extending away from the right boundary L is defined as one of the leftwards inclined wires 3 while a portion of the N-th rightwards inclined wire 2*n* extended in the third direction z is defined as the right side boundary wire 6. Similarly, from the end 52 (i.e., the intersection O), after forming the twine portion 5 on the left boundary L, the left side boundary wire 6 is extended in the first direction x and the first leftwards inclined wire 3*a* is extended in the third direction z, wherein a portion of the left side boundary wire 6 extending away from the left boundary L is defined as one of the rightwards inclined wires 2 while a portion of the first leftwards inclined wire 3*a* extended in the third direction z is defined as the left side boundary wire 6.

Next, at step (g), from the intersection O of each rightwards inclined wire 2 and a respective one of the leftwards inclined wires 3, the inclined wires 2 and 3 are extended away from the first boundary wire 1 in the third direction z and intertwined a plurality of turns to form a twine portion 5 having a beginning 51 and an end 52.

At step (h), the procedures mentioned in steps (d)-(g) are repeated until a net structure with a desired size is obtained. More specifically, by repeating steps (d)-(g), a net structure with a desired size and with a plurality of hexagonal meshes shown in FIG. 4 can be obtained.

With reference to FIG. 4, the second end of each of the wires 2, 3, and 6 can be fixed to a second boundary wire 4 after a net structure having a desired size is obtained. Thus, a net structure having the second boundary D and two side boundaries L is obtained.

Figure 5:
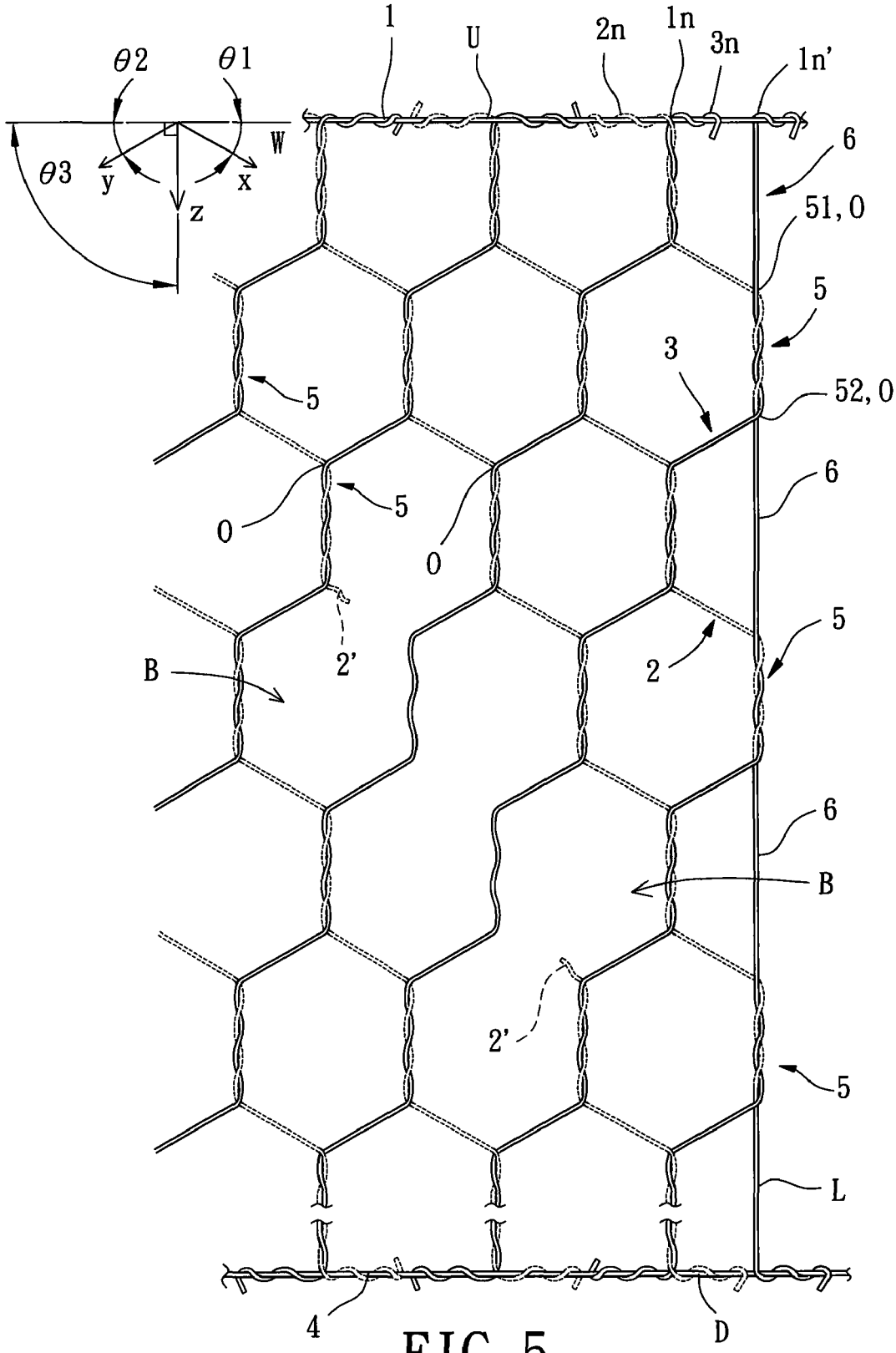
FIG. 5 shows a partial, plan view of a net structure according to the preferred teachings of the present invention with a portion of the net structure broken.

With reference to FIG. 5, the net structure according to the preferred teachings of the present invention can be utilized as a net to hold stones or a fence. In a case that the net structure according to the preferred teachings of the present invention is utilized as a stone net, since each rightwards inclined wire 2 is intertwined with a plurality of leftwards inclined wires 3 to form a plurality of twine portions 5, a cross-weaved net structure is obtained. Thus, when one of the rightwards inclined wires 2 is broken, only a couple of holes B equal to the size of two meshes is generated. Even the length of the broken rightwards inclined wire 2 is increased, only the number of the holes B is increased, not the size of the holes B. As a result, when the net structure according to the preferred teachings of the present invention is utilized as a stone net, the net structure is increased in structural strength, providing enhanced effect for avoiding landslide.

Furthermore, in the net structure according to the preferred teachings of the present invention, no extra metal wires are required at the side boundaries L for intertwining of the rightwards and leftwards inclined wires 2 and 3, reducing difficulties of manufacture while enhancing the overall structural strength of the net structure.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A method for making a net structure comprising:

(a) selecting a plurality of positioning points on a boundary;

(b) providing a plurality of rightwards inclined wires and a plurality of leftwards inclined wires, with a first end of each of the rightwards inclined wires and a first end of a respective one of the leftwards inclined wires fixed to a respective one of the positioning points;

(c) intertwining and extending a second end of each of the rightwards inclined wires and a second end of a respective one of the leftwards inclined wires, with the second end of each of the rightwards inclined wires and the second end of a respective one of the leftwards inclined wires being intertwined a plurality of turns to form a twine portion having a beginning fixed to a respective one of the positioning points and an end distant to the boundary, with each of the beginning and the end being an intersection, wherein the twine portion has an even number of turns;

(d) extending each of the rightwards inclined wires from the end of the twine portion in a first direction, and extending each of the leftwards inclined wires from the end of the twine portion in a second direction, with each of the rightwards inclined wires intersecting an adjacent one of the leftwards inclined wires at another intersection;

(e) extending and intertwining each of the rightwards inclined wires and a respective one of the leftwards inclined wires from one of the intersections away from the boundary, with each of the rightwards inclined wires and a respective one of the leftwards inclined wires being intertwined a plurality of turns to form a twine portion having a beginning adjacent to the boundary and an end distant to the boundary, wherein the twine portion has an even number of turns; and (f) repeating steps (d) and (e) until a net structure with a desired size and hexagonal mesh is obtained.

2. The method for making the net structure as claimed in claim 1, with the boundary being a first boundary wire.

3. The method for making the net structure as claimed in claim 2, further comprising: fixing the second ends of the rightwards and leftwards inclined wires to a second boundary wire after obtaining the net structure with the desired size.

4. The method for making the net structure as claimed in claim 2, with the positioning points being spaced at regular intervals.

5. The method for making the net structure as claimed in claim 2, further comprising: winding and fixing the first ends of the plurality of rightwards and leftwards inclined wires along the first boundary wire.

6. The method for making the net structure as claimed in claim 1, with the first end of each of the rightwards inclined wires and the first end of a respective one of the leftwards inclined wires being connected together.

7. The method for making the net structure as claimed in claim 1, with a number of turns of each of the twine portions is even.

8. A method for making a net structure comprising:

(a) selecting a plurality of positioning points and two side positioning points on a boundary, with the plurality of positioning points arranged between the two side positioning points;

(b) providing a plurality of rightwards inclined wires, a plurality of leftwards inclined wires, and two side boundary wires, with a first end of each of the rightwards inclined wires and a first end of a respective one of the leftwards inclined wires fixed to a respective one of the positioning points, with first ends of the two side boundary wires respectively fixed to the two side positioning points;

(c) extending and intertwining a second end of each of the rightwards inclined wire and a second end of a respective one of the leftwards inclined wires, with the second end of each of the rightwards inclined wires and the second end of a respective one of the leftwards inclined wires being intertwined a plurality of turns to form a twine portion having a beginning fixed to a respective one of the positioning points and an end distant to the boundary, and extending the two side boundary wires away from the boundary, wherein the twine portion has an even number of turns;

(d) extending each of the rightwards inclined wires from the end of the twine portions in a first direction, and extending each of the leftwards inclined wires from the end of the twine portions in a second direction, with each of the rightwards inclined wires intersecting an adjacent one of the leftwards inclined wires or one of the two side boundary wires at an intersection;

(e) extending and intertwining the rightwards inclined wires, the leftwards inclined wires, and the two side boundary wires from each of the intersections away from the boundary a plurality of turns to form a plurality of twine portions, with each of the twine portions including a beginning and an end;

(f) extending each of the rightwards inclined wires in the first direction and extending each of the leftwards inclined wires in the second direction, with a right side boundary wire of the two side boundary wires being intertwined with one of the rightwards inclined wires a plurality of turns and then extending in the second direction, with a left side boundary wire of the two side boundary wires being intertwined with one of the rightwards inclined wires a plurality of turns and then extending in the first direction, with one of the rightwards inclined wires and one of the leftwards inclined wires extending in a third direction away form the boundary, and defining a portion of the right side boundary wire extending in the second direction as one of the leftwards inclined wires, a portion of the left side boundary wire extending in the first direction as one of the rightwards inclined wires, and the rightwards and leftwards inclined wires extending in the third direction as the two side boundary wires;

(g) extending and intertwining each of the rightwards inclined wires and a respective one of the leftwards inclined wires from the intersection away from the boundary a plurality of turns to form a plurality of twine portions each having a beginning and an end; and (h) repeating steps (d)-(g) until a net structure with a desired size and hexagonal mesh is obtained.

9. The method for making the net structure as claimed in claim 8, with the boundary being a first boundary wire.

10. The method for making the net structure as claimed in claim 9, further comprising: fixing the second ends of the rightwards and leftwards inclined wires and the two side boundary wires to a second boundary wire after obtaining the net structure with the desired size.

11. The method for making the net structure as claimed in claim 9, with the positioning points being spaced at regular intervals.

12. The method for making the net structure as claimed in claim 9, further comprising: winding and fixing the first ends of the rightwards and leftwards inclined wires along the first boundary wire.

13. The method for making the net structure as claimed in claim 8, with the first end of each of the rightwards inclined wires and the first end of a respective one of the leftwards inclined wires being connected together.

14. The method for making the net structure as claimed in claim 8, with a number of turns of each of the twine portions is even.

15. A net structure comprising:

a plurality of metal rightwards inclined wires extending in a first direction and including, in sequence, a first rightwards inclined wire, a second rightwards inclined wire, . . . and an N-th rightwards inclined wire;

a plurality of metal leftwards inclined wires extending in a second direction away from the first direction and including, in sequence, a first leftwards inclined wire, a second leftwards inclined wire, . . . and an N-th leftwards inclined wire;

with the first rightwards inclined wire intersecting, in sequence, from the first leftwards inclined wire through the N-th leftwards inclined wire at intersections at which twine portions are formed, with the second rightwards inclined wire intersecting, in sequence, from the second leftwards inclined wire through the N-th leftwards inclined wire at intersections at which twine portions are formed, . . . with the N-th leftwards inclined wire intersecting the N-th rightwards inclined wire at an intersection at which a twine portion is formed, thereby forming a net structure with a plurality of hexagonal meshes, wherein each twine portion has an even number of turns.

16. The net structure as claimed in claim 15, further comprising: a first boundary wire, with the first ends of the rightwards and leftwards inclined wires fixed to the first boundary wire.

17. The net structure as claimed in claim 16, further comprising: a second boundary wire, with the second ends of the rightwards and leftwards inclined wires fixed to the second boundary wire.

18. The net structure as claimed in claim 17, further comprising: two side boundary wires, with a rightmost one of the rightwards inclined wires intertwined with one of the two side boundary wires a plurality of turns, with a leftmost one of the leftwards inclined wires intertwined with another of the two side boundary wires a plurality of turns.

* * * * *